US009061396B2

(12) United States Patent
Rutten et al.

(10) Patent No.: US 9,061,396 B2
(45) Date of Patent: Jun. 23, 2015

(54) ABRASIVE BLASTING METHOD AND CONTROL DEVICE FOR SUCH A METHOD

(75) Inventors: Leon Rutten, Housse (BE); Jean Rutten, Blegny (BE)

(73) Assignee: ROSLER HOLDING GMBH & CO. KG (DE)

( * ) Notice: Subject to any disclaimer, the term of this patent is extended or adjusted under 35 U.S.C. 154(b) by 280 days.

(21) Appl. No.: 13/640,032

(22) PCT Filed: Apr. 6, 2011

(86) PCT No.: PCT/BE2011/000018
§ 371 (c)(1),
(2), (4) Date: Jan. 7, 2013

(87) PCT Pub. No.: WO2011/123906
PCT Pub. Date: Oct. 13, 2011

(65) Prior Publication Data

US 2013/0122781 A1 May 16, 2013

(30) Foreign Application Priority Data

Apr. 8, 2010 (BE) ..... 2010/0225

(51) Int. Cl.
*B24C 1/00* (2006.01)
*B24C 5/06* (2006.01)
*B24C 7/00* (2006.01)
*B24C 9/00* (2006.01)

(52) U.S. Cl.
CPC ..... *B24C 7/0092* (2013.01); *B24C 5/06* (2013.01); *B24C 9/00* (2013.01)

(58) Field of Classification Search
CPC ..... B24C 7/0092; B24C 5/06; B24C 9/00
USPC ..... 451/2, 8, 38, 95
See application file for complete search history.

(56) References Cited

U.S. PATENT DOCUMENTS

| | | | | |
|---|---|---|---|---|
| 2,385,728 A | | 9/1945 | Potter | |
| 3,521,406 A | * | 7/1970 | Carpenter, Jr. | 451/89 |
| 4,470,292 A | * | 9/1984 | DeClark et al. | 73/11.02 |
| 4,941,297 A | | 7/1990 | Carpenter | |
| 5,731,509 A | | 3/1998 | Thompson | |
| 5,779,524 A | * | 7/1998 | Swain | 451/102 |

FOREIGN PATENT DOCUMENTS

CN 86102068 A 10/1986

(Continued)

OTHER PUBLICATIONS

Belgian Search Report dated Oct. 15, 2010.

(Continued)

*Primary Examiner* — Maurina Rachuba
(74) *Attorney, Agent, or Firm* — Amster, Rothstein & Ebenstein LLP

(57) ABSTRACT

Abrasive blasting control method in which a control device (10) is used including at least a swing-arm (13) and in which the movement of the swing-arm (13) is controlled from the exterior of the casing of the wheel from its rest position to its second position in which said swing arm (13) is subjected to a part of the jet of abrasives leaving the wheel (1).

22 Claims, 5 Drawing Sheets

(56) References Cited

FOREIGN PATENT DOCUMENTS

| | | | |
|---|---|---|---|
| CN | 1166149 | A | 11/1997 |
| DE | 10055974 | C1 | 10/2001 |
| DE | 10332713 | B3 | 7/2004 |
| EP | 1332348 | | 11/2001 |
| EP | 1915963 | A1 | 4/2008 |
| FR | 2885311 | A1 | 5/2005 |
| JP | H04315578 | A | 11/1992 |

OTHER PUBLICATIONS

International Search Report of PCT/BE2011/000018 dated Aug. 10, 2011.

Written Opinion of the International Searching Authority dated Oct. 8, 2011.

Plaster, H.J., "Blast Cleaning and Allied Processes," vol. II.

Chinese Search Report.

* cited by examiner

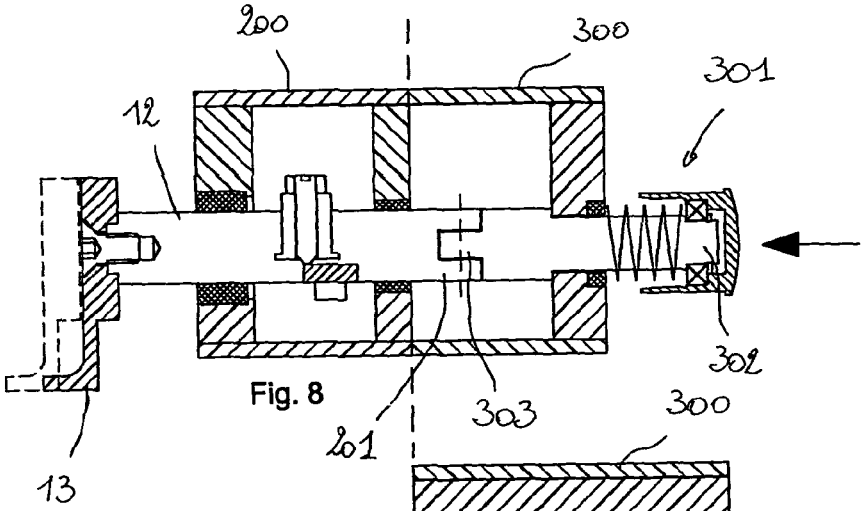
Fig. 8
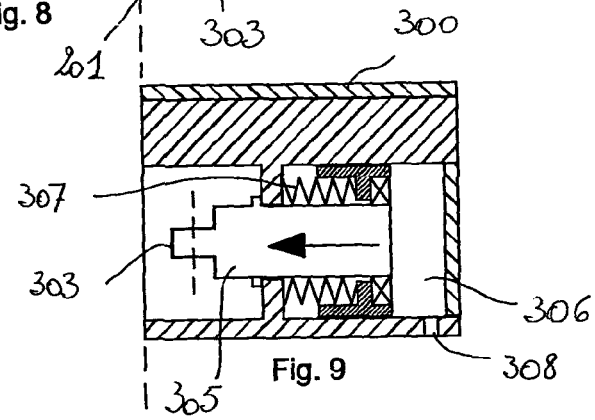
Fig. 9
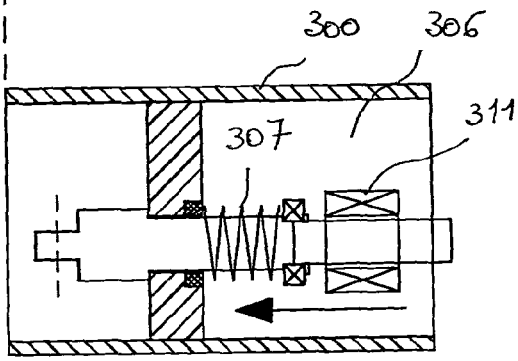
Fig. 10
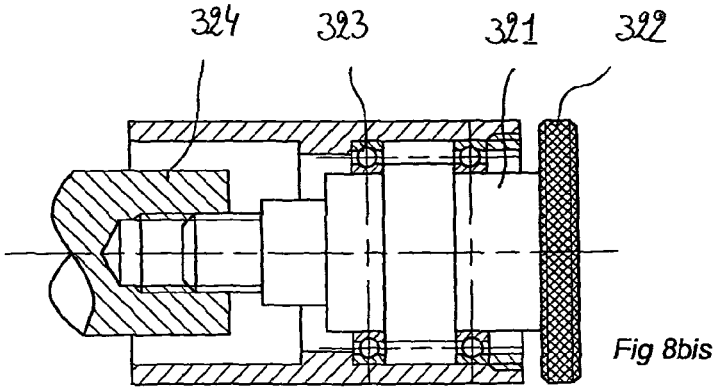
Fig 8bis

ABRASIVE BLASTING METHOD AND CONTROL DEVICE FOR SUCH A METHOD

An object of the present invention is a method of controlling or adjusting a surface treatment effected by abrasive blasting by means of abrasion agents leaving an abrasive blasting wheel.

Known in the art are abrasive blasting wheels including (a) blades advantageously extending between two parallel flanges or disks, (b) a support on which the flanges and blades of the wheel are rotatably mounted, (c) an abrasives distributor placed at the centre of the wheel and fastened to the wheel, and (d) a control member that is not driven in rotation during rotation of the wheel and is placed around the distributor, said control member having a slot or opening for controlling the exit of the jet of abrasives from the wheel after said abrasives have been moved along the blades by centrifugal force, said control member being mounted to be movable relative to the support to enable adjustment of the position of the slot or opening of the control member relative to the support to control the exit of the jet of abrasives.

The orientation of the slot in the control member makes it possible to define or modify the exit of the shower of abrasives or abrasion agents. The shower of abrasives does not have a constant density of abrasives over all of its extent. In or near the central part of the shower the density of the sprayed abrasives is higher, which therefore creates on the part to be treated an area with a maximum impact density and maximum temperature rise. The direction of abrasives of the shower having the highest density of sprayed abrasives is the principal direction of the abrasives of the shower. The area with the highest impact density thus constitutes the hot spot of the abrasive blasting wheel. General information relating to the abrasives, their direction, their density, the hot spot, etc. is given in volume II of "Blast Cleaning and Allied Processes" by H. J. Plaster, first published in 1973 by Industrial Newspapers Limited, The Garden City Press Limited, United Kingdom.

Controlling the position of the ideal hot spot of an abrasive blasting wheel before carrying out an abrasive blasting operation is important for adapting the position of the control member to check the principal direction of the shower of abrasives on the target or the object to be abrasive blasted, to check effective abrasive blasting of the object to be abrasive blasted, and also to check that the abrasives do not damage the lining of the wheel, of the walls of the cabin, etc.

The hot spot of an abrasive blasting wheel depends on the wheel, in particular the position of its control member, the friction of abrasives in the wheel, etc., and also on the abrasives used (for example their shape, their hardness, the nature of the alloy of the abrasives, steel, stainless steel, ceramic, etc.). The ideal hot spot of an abrasive blasting wheel is that producing the maximum impact energy on the target to be treated. A few applications demand hot spots departing little from the ideal hot spots. The geometry of the parts to be abrasive blasted, the disposition of the wheels in the cabin, sometimes require hot spot adjustments different from the ideal hot spot of each wheel. Reference will then be made to the "required hot spot", which is different from the ideal hot spot, the position of which is linked to the characteristics of the wheel. Thus for a particular type of abrasive, each wheel has a unique ideal hot spot.

All these parameters are adjusted by controlling the angular position of the control member.

To determine the hot spot of an abrasive blasting wheel using particular abrasives, it is known to place wood planks in the area of the shower of abrasives leaving the wheel. The area of the plank most attacked by the abrasives is the hot spot of the wheel. Using predefined curves or formulas it is then possible to determine the rotation that the control member must undergo for the hot spot to move toward the required hot spot.

This operation takes time, as it is necessary to place the plank or planks correctly in the abrasive blasting cabin and to hold them in position during abrasive blasting and then to remove the planks from the cabin and analyse them. Once this analysis has been effected, the optimum position of the control member can be determined.

If the plank is not thick enough, there is a risk of the abrasives damaging the interior faces of the cabin.

Such determination necessitates stopping the abrasive blasting of the parts or objects to be abrasive blasted. Moreover, a large quantity of wood dust is generated.

Visual inspection of abrasive blasting via a porthole in the cabin or a video camera situated in the cabin might also be considered. Given the quantity of dust generated during abrasive blasting, however, the porthole or the video camera would quickly become soiled, preventing a correct view and thus preventing any inspection.

Also known is a method for evaluating the jet of abrasives in which a series of reference test pieces (Almen strips mounted on a support bar) is disposed in the jet of abrasives. When these reference test pieces are subjected to a jet of abrasives they deform as a function of the impact energy of the jet of abrasives. One such reference test piece is described in the document U.S. Pat. No. 5,731,509.

Once these test pieces have been subjected to abrasive blasting, it is necessary to remove the bar provided with them from the cabin and to analyse each deformation to determine a map of the deformation.

Placing the bar provided with these test pieces in an abrasive blasting cabin and removing it therefrom are operations that are often unpleasant, given the ambient temperature of 60° C. to 80° C. in the cabin. This often leads to inadequate or non-optimum placing of the test pieces and/or incorrect measurement of the hot spot, or even failure to measure the hot spot. Thus a method of this kind requires time to carry it out, so that in general scrupulous companies carry out a hot spot test only at intervals of one working week or longer. In most cases the hot spots are tested during major servicing, i.e. two or three times a year in the best case scenario.

Also known is a method for determining the hot spot of an abrasive blasting installation in which a reference plate is used the face of which opposite that which is exposed to abrasive blasting is provided with a series of temperature sensors (FR2885311, EP1332348). This method thus makes it possible to produce a map of the heating of the reference plate.

The determination of the hot spot by this method cannot be carried out during the abrasive blasting of a part. This method therefore does not make it possible to determine whether abrasive blasting is optimized during abrasive blasting.

To prevent excessive deformation or wear of the reference plate associated with the sensors, it is necessary to remove the reference plate after the test. Placing the reference plate in an abrasive blasting cabin or removing it therefrom is often unpleasant, given the high ambient temperature in the cabin, which makes adequate or optimum placement of the test piece and thus correct measurement of the hot spot unpleasant and difficult. Given this high ambient temperature, operators often fail to carry out the hot spot measurements.

EP1915963 relates to a method of force estimation for a minimally invasive medical system comprising a robot manipulator. The manipulator has an effector unit equipped with a 6 degrees-of-freedom (DOF) force/torque sensor and is configured to hold a minimally invasive instrument having a first end mounted to the effector unit and a second end located beyond an external fulcrum that limits the instrument in motion. The robot manipulator is adapted for chirurgical or medical operation, not for being submitted to the action of a jet of abrasives or abrasive particles, i.e. not adapted for the method as claimed in the attached claims (if in the method of EP1915963, the force is of a few grams, during a blasting operation, the forces are more than about 1000 times higher). In the manipulator of EP1915963, the sensor is in direct and permanent contact with the body of the patient, and the force and torque are measured at said contact point.

An object of the present invention is a method for controlling or adjusting an abrasive blasting operation enabling:

- precise controlling of the ideal hot spot and thus precise and rapid adjustment of the control member to obtain the required hot spot, from outside the cabin, and/or
- controlling or adjusting abrasive blasting during abrasive blasting of parts, and/or
- rapid determination of the hot spot, the departure of the real hot spot relative to the optimum hot spot or the principal direction of the jet of abrasives, and/or
- placing the control device in the jet of abrasives without having to enter the cabin, and/or
- adjusting the control member as a function of a signal coming from the control device, where appropriate after processing, and/or
- determination (reliable determination) of a parameter as a function of the direction of impact of the abrasives, despite any deposition of dust on the device used, and/or
- controlling the regularity or variations in the principal direction of the jet of abrasives.

The invention provides a method of controlling or adjusting a surface treatment effected by abrasive blasting by means of abrasion agents from a surface treatment device including an abrasive blasting wheel driven in rotation about an axis and emitting a jet of abrasion agents, said abrasion blasting wheel including (a) blades advantageously extending between two flanges or disks, (b) a support on which the wheel is rotatably mounted, (c) an abrasives distributor placed at the centre of the wheel and fastened to the wheel, and (d) a control member that is not driven in rotation during rotation of the wheel, placed around the distributor, said control member having a slot or opening controlling the feeding of abrasives to the blades and the exit of the jet of abrasives from the wheel after said abrasives have been moved along the blades by centrifugal force, said control member being mounted movably with respect to the support to allow adjustment of the position of the slot or opening of the control member relative to the support (for example by angular adjustment of the control member about the rotation axis (X) of the wheel) to control the exit of the jet of abrasives.

In this method a control device (10) is used including at least one swing-arm (13) mounted movably relative to a wall (5*b*) protected by a lining (9) of a wheel casing or an abrasive blasting chamber, said wall and lining (5*b*, 9) having a first face facing toward the jet of abrasives leaving the wheel (1) and a second face opposite said first face, said second face facing toward an area protected from the abrasives, said swing-arm (13) being mounted movably relative to said first face between a first position (FIG. 6) for which the swing-arm (13) is not situated in the jet of abrasives leaving the wheel (1) and a second position (FIG. 7) in which the swing-arm (13) or an element (18) thereof is situated in part of the jet of abrasives leaving the wheel (1), said swing-arm being mounted rotatably relative to an axis (C) substantially parallel to the rotation axis (X) of the abrasive blasting wheel (1) so that in the second position of the swing-arm the jet of abrasion agents or abrasives acting on the swing-arm or the element (18) is able to generate a rotation torque.

The method of the invention includes at least the following steps:

the movement of the swing-arm is controlled from outside the casing of the wheel or from outside the abrasive blasting cabin via a placement device, from its first rest position protected from the abrasives, to move said swing-arm or an element thereof into a portion of the jet of abrasives leaving the wheel;

at least one system, for example a torque measuring system or an on/off system, determines at least one parameter as a function of any rotation torque generated and/or as a function of any rotation of the swing-arm, i.e. measures the action of the abrasives on said swing-arm or element thereof;

there is determined as a function of said parameter or the measurement a parameter as a function of the hot spot and/or a parameter for adjusting the position of the control member of the wheel to obtain a required hot spot;

the position of the control member of the wheel is corrected if necessary; and the swing-arm of the control device is moved from its second position toward its first position to move said swing-arm or an element thereof out of the jet of abrasives leaving the wheel. The position of the control member is generally corrected when the control device is removed from the jet of abrasives, but this is not obligatory. For a control member driven by an electric or pneumatic actuator, for example, it is entirely possible to effect the correction of the angle of the control member while the measuring system (swing-arm or part thereof) is in the jet of abrasives during the measuring phase.

Thus the method of the invention allows controlling of the jet of abrasives leaving the wheel without obliging an operator to enter the abrasive blasting cabin.

Such a method is simple to implement and very reliable.

One embodiment of the invention advantageously determines a control parameter and/or a correction parameter for the control member of the wheel as a function of one or more parameters as a function of any rotation torque and/or any rotation of the swing-arm of the control device and as a function of the required hot spot, and the position of the control member of the wheel is adjusted by rotation as a function of said control parameter and/or said correction parameter of the control member of the wheel.

According to a detail of the method of the invention, for an abrasive blasting wheel having a given ideal hot spot:

- said swing-arm and/or said member is/are moved between the first position and the second position, before and/or during abrasive blasting,
- the position of the control member of the wheel is adjusted so that the jet of abrasives leaving the wheel is directed to produce the ideal hot spot of the wheel, and
- there is determined as a function of at least one predefined curve or formula and as a function of the required hot spot the necessary rotation of the control member of the wheel relative to the position of the control member producing the ideal hot spot to direct the jet of abrasives leaving the wheel to produce the required hot spot.

According to another detail of the method of the invention, if the parameter as a function of any rotation torque generated and/or any rotation of the swing-arm is no longer included in a range of permissible values:

- at least one signal is sent, and/or
- abrasive blasting is stopped, and/or the position of the control member of the wheel is adjusted so that said parameter as a function of any rotation torque generated and/or any rotation of the swing-arm is/are included in a range of permissible values.

The range of permissible values is advantageously a range of values determined relative to the required or ideal hot spot of the wheel, in particular a range of values offset relative to the range of values determined relative to the ideal hot spot.

The control member is generally adjusted manually by simply unscrewing clamping claws retaining it and the control member is generally rotated manually although this adjustment rotation may also be carried out by a pneumatic actuator or ideally by an electric actuator.

In one advantageous embodiment of the invention, for a wheel having an ideal plane (V1) in which abrasives or abrasion agents are moved toward a target plane (PC) perpendicular to said ideal plane (V1) with maximum impact energy, said swing-arm (13) is placed so that its rotation axis (C) is situated in or substantially in said ideal plane (V1).

According to particular features of methods of the invention:

the control member of the wheel is associated with means for adjusting the position of the control member relative to the casing support, said means including at least one electric actuator for stepwise rotation of the control member of the wheel relative to the support, in particular during abrasive blasting.

When the control member is actuated by an electric actuator or any other device, for example gears, the hot spot controlling device of the invention allows adjustment of the control member and continuous automatic tracking of the target to be abrasive blasted via an electronic module controlled by the hot spot controlling device.

At least one step of controlling the exit of the jet of abrasives by a control method of the invention is advantageously carried out at least at the beginning of abrasive blasting of an object.

In a method in which a series of objects is treated successively, continuously or semi-continuously by abrasive blasting, at least one step of controlling the jet of abrasives is carried out at least once per abrasive blasting period of one week or ideally every 24 hours or even less, (for example every eight hours), when the degree of wear of component parts of the wheel is high. According to a detail of a method in which the parts are abrasive blasted in an optimum and ideal manner with a jet of abrasion agents leaving the wheel whose maximum density strikes the target plane perpendicularly or in a less than ideal manner that is made necessary by the abrasive blasting requirements, at a predetermined angle relative a straight line substantially perpendicular to the target plane. After an operation of controlling the exit of the jet of abrasives from the wheel, there is determined a corrective parameter of the position of the slot or opening of the control member and the position of the slot or opening is modified during abrasive blasting or between the abrasive blasting of two successive parts, to obtain a jet of abrasives whose maximum and ideal impact density strikes the target plane perpendicularly or at an angle other than a right angle necessitated by the abrasive blasting requirements or the wheel positioning geometry.

The invention also provides a device adapted to control or adjust the exit of the jet of abrasives in a method according to the invention, said device including:

(a) a support adapted to be mounted on and fixed to a wall protecting against the jets of abrasives or simply on the exterior wall of the casing of the wheel;

(b) a swing-arm mounted movably relative to the support between a first position so that when said support is mounted on the protecting wall or the wall of the wheel casing the swing-arm is not situated in the jet of abrasives leaving the wheel and a second position in which the swing-arm or an element thereof is away from the support, the swing arm of the element thereof is then situated in a part of the jet of abrasives leaving the wheel; and (c) at least one system or measuring system adapted to measure or estimate at least one parameter or one measurement of the action of the abrasives on said swing-arm or element thereof.

The swing-arm is advantageously mounted to rotate freely relative to the support and the measuring system is advantageously adapted to measure or estimate a parameter as a function of the rotation torque generated by the abrasives on the swing-arm and/or as a function of the rotation of the swing-arm generated by the jet of abrasives.

The measuring device preferably includes at least a rod or a shaft sliding in a guide system fastened to the support to guide the movement of the swing-arm between its first position and its second position.

According to one feature, the device includes:

return means acting on the swing-arm or a part fastened thereto to return the swing-arm from its second position, the movement of the swing-arm from its second position to its first position being effected against the action of said return means, and/or one or more connections for sending one or more signals to an alarm or indicator system, indicator lamps, and/or to a system for determining a correction parameter for the position of the control member of the wheel and/or to a system for correcting the position of the control member of the abrasive blasting wheel and/or to a system for indicating or storing one or more parameters of an abrasive blasting operation.

The invention further provides an assembly selected from the group comprising an abrasive blasting wheel casing, an abrasive blasting wheel and an abrasive blasting cabin, said assembly being associated with at least one control device of the invention.

In particular, the invention provides an abrasive blasting wheel one wall of the casing of which is associated with a device of the invention and an abrasive blasting cabin associated with a control device of the invention, advantageously with an abrasive blasting wheel where a wall of the casing of the wheel is associated with a device of the invention.

Particular features and details of the invention emerge from the following detailed description of preferred embodiments of the invention given by way of example only and with reference to the appended drawings.

In the drawings:

FIG. 8 is a simplified view of a second hot spot measuring device in which the control device is placed manually;

Figure 11:
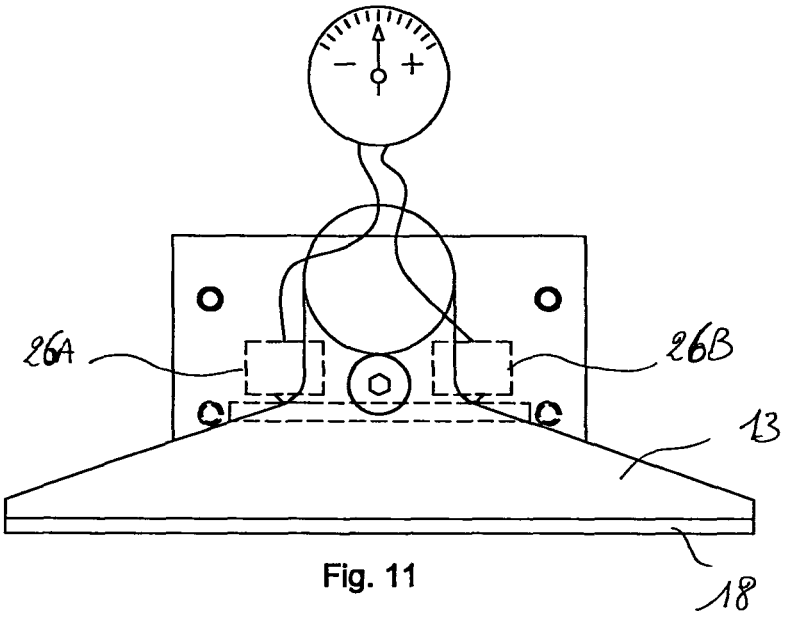
Figure 12:
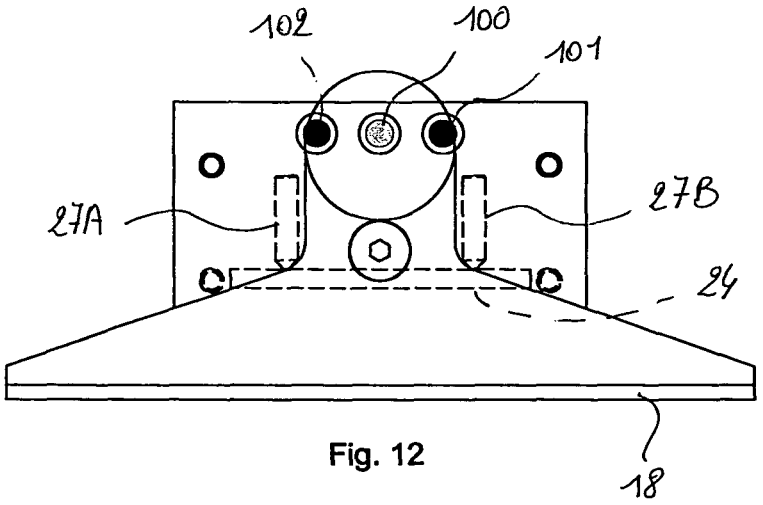

FIG. 8*bis* is a simplified view of a measuring device similar to that from FIG. 8;

FIG. 9 is a simplified view of a third system for placing the measuring device using a pneumatic or possibly hydraulic actuator;

FIG. 10 is a diagrammatic view of a fourth system for placing the measuring device using a solenoid actuator;

FIG. 11 is a diagrammatic view of a measuring device bearing via a rod on piezo-electric sensors indicating the value of the tilting torque; and FIG. 12 is a view of a device similar to that from FIG. 11 in which the piezo-electric sensors have been replaced by simple electrical contacts indicating to which side tilting occurs, without quantifying the exact value of the force or the torque.

Figure 2:
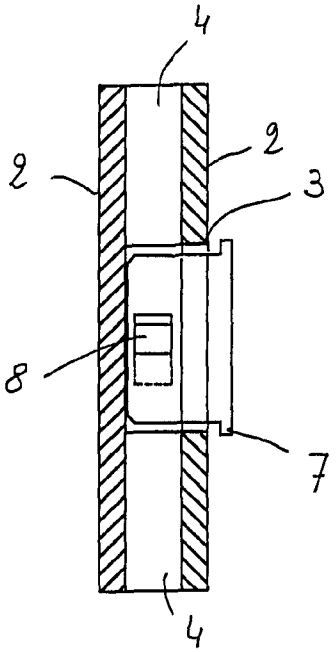
FIG. 2 is a profile view of the wheel from FIG. 1 partially in section on the line II-II.
Figure 1:
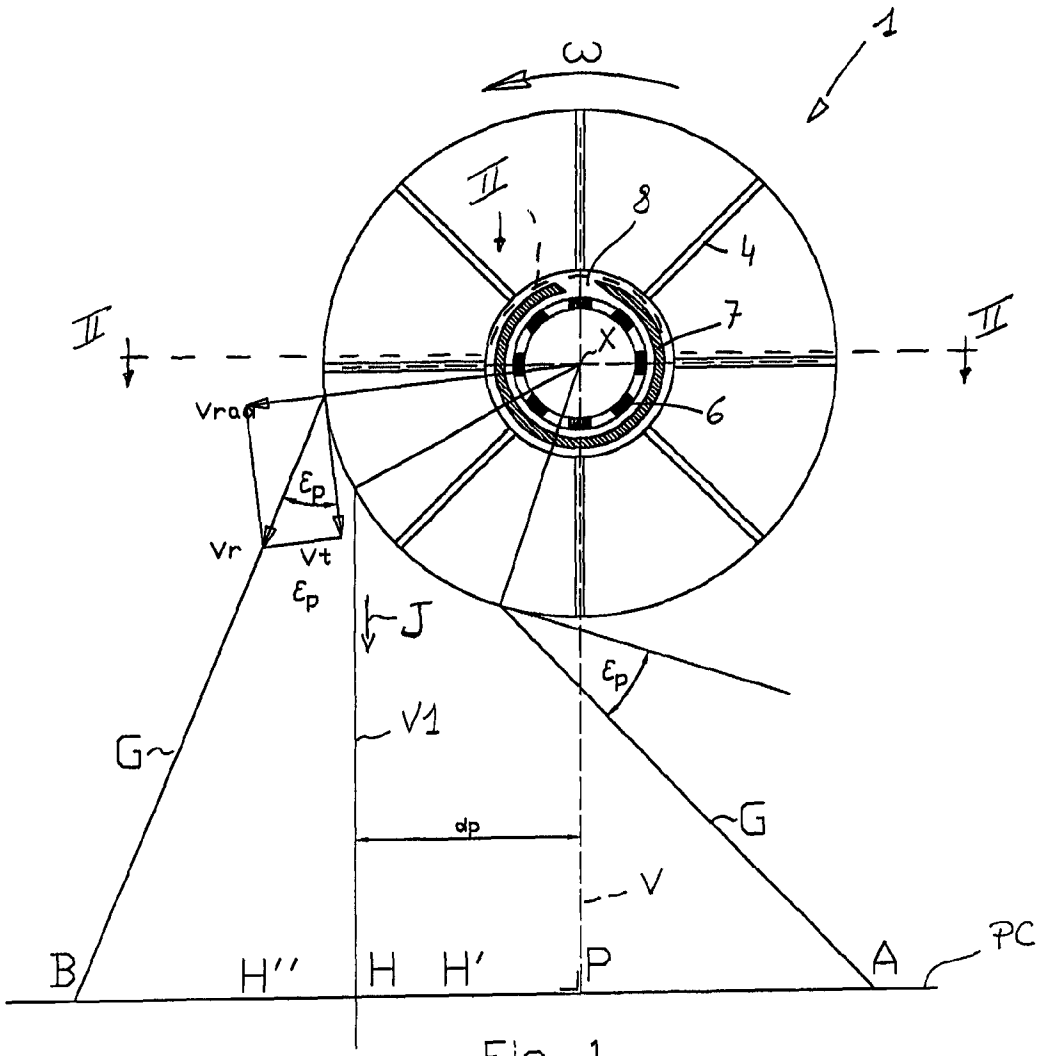
FIG. 1 is a view in section of an abrasive blasting wheel rotating to the left.
Figure 3:
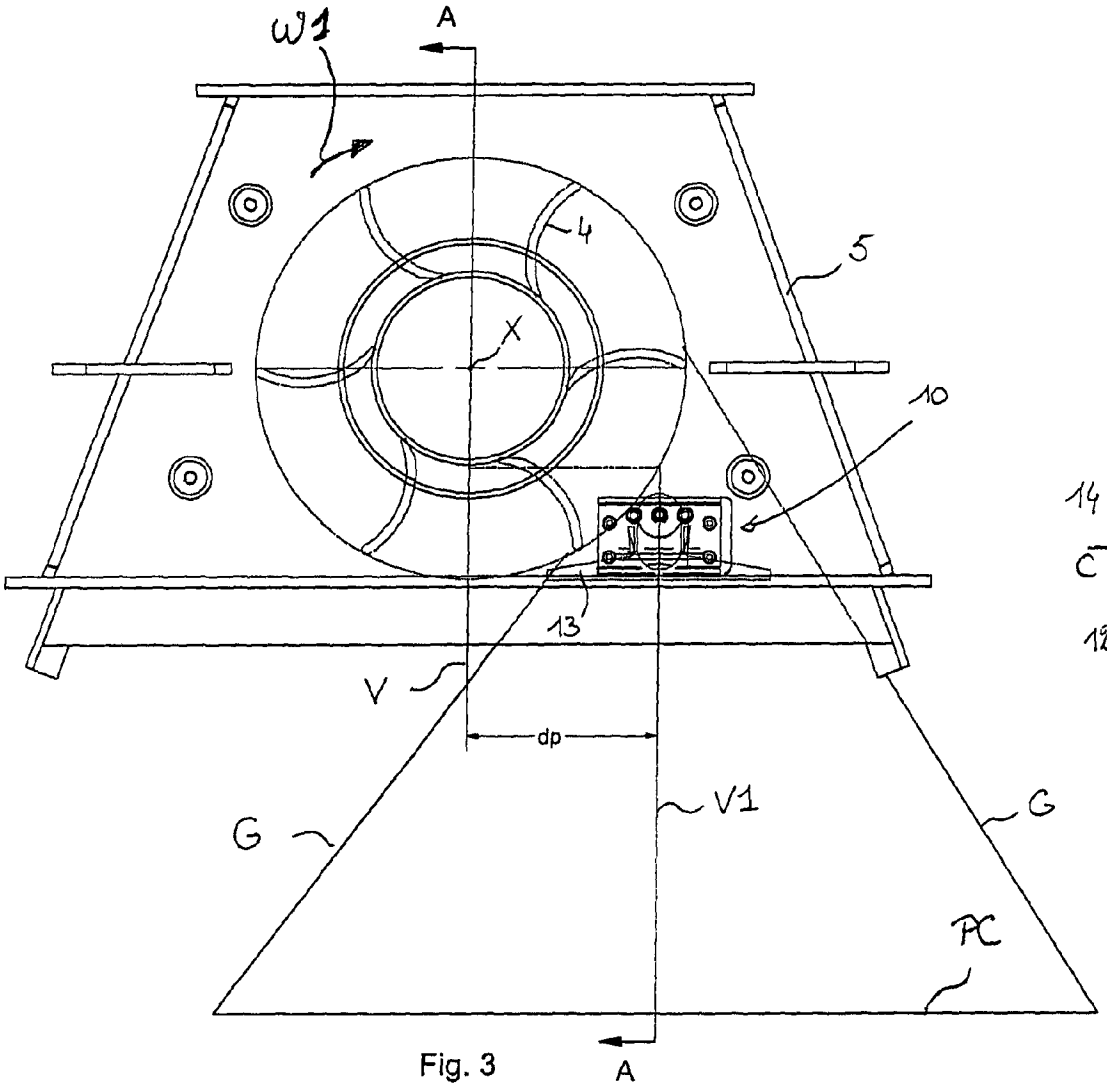
FIG. 3 is a front view of the wheel from FIG. 1 (but with curved blades instead of straight blades) associated with a control device of the invention.
Figure 5:
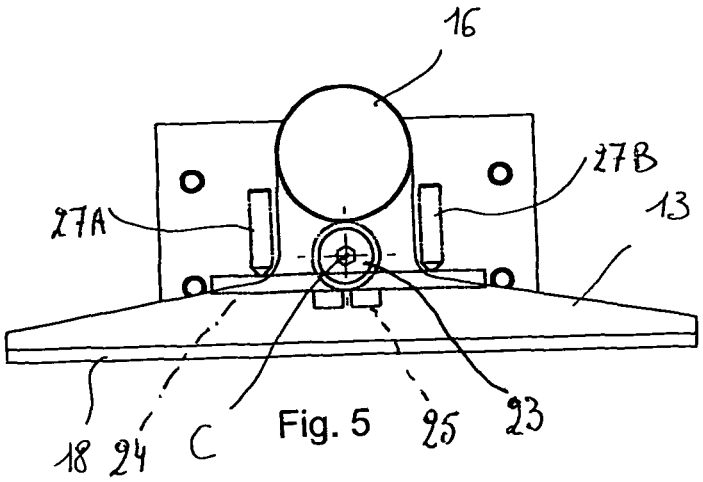
FIG. 5 is a view to a larger scale of the control device from FIG. 3.

FIG. 1 is a diagrammatic view of an abrasive blasting wheel. This wheel 1 includes:

- two parallel flanges or disks 2, one of which is solid while the other of which has a central opening 3,
- radial or curved blades 4 extending between the two flanges or disks 2,
- a support or frame 5 (see FIG. 3) on which the two flanges 2 are rotatably mounted,
- an abrasives distributor 6 placed at the centre of the wheel and fastened to the wheel, and therefore turning with it,
- a motor (not shown) for driving in rotation (arrow ω) the flanges 2, the blades 4 and the distributor 6 relative to the casing 5, and
- a control member 7 not driven in rotation during rotation of the wheel 1, this control member being placed around the distributor 6, said control member having a slot or opening 8 for controlling the entry of abrasives into the wheel (at the centre) and the exit of the jet of abrasives from the wheel after said abrasives have been moved along the blades by centrifugal force, said control member being mounted movably relative to the support (casing) 5 to allow adjustment of the slot or opening 8 of the control member 7 relative to the support 5 to control the exit of the jet of abrasives (principal direction J) for which the abrasives density is highest, but fixed in position once it has been adjusted. By angular adjustment of the control member 7 around the axis X it is possible to adjust the principal direction J of the jet of abrasives.

The angular orientation (relative to a reference plane V passing through the rotation axis X of the wheel 1, in particular relative to a vertical plane) of the slot or opening 8 (the shape of which may be diverse, for example square, rectangular or trapezoidal) defines the shower G of abrasives thrown off by the wheel. This shower G of abrasives does not have a constant density over the whole of its extent, for example between the points A and B. The hot spot is the area in which the impact energy is at a maximum. Under normal conditions of adjustment of the control member 7, the hot spot of the wheel 1 corresponds to the point H in FIG. 1, the impact point of abrasives leaving perpendicularly to the target plane PC.

The adjustment of the hot spot or the maximum impact area is important to ensure that the energy of impact on the part to be abrasive blasted is substantially at a maximum, and thus to ensure effective abrasive blasting, but also to prevent too much abrasives being directed directly onto linings of the wheel or the blasting cabin.

This adjustment is obtained by adapting the angular position of the slot or window of the control member relative to a reference plane, here the vertical plane V passing through the rotation axis X of the wheel 1.

The control member 7 is not driven in rotation during rotation of the wheel, with the result that the adjustment (by rotation) of the position of the control member relative to the plane V modifies the exit direction of the portion of the jet J of abrasives that has the highest density. In FIG. 1, rotation of the control member in the clockwise direction (the direction opposite the direction of rotation of the wheel 1) causes displacement of the hot spot H toward the point B, whereas rotation of the control member in the anticlockwise direction (the rotation direction of the wheel 1) causes displacement of the hot spot H toward the point A.

The abrasive blasting wheel driven in rotation in the direction of the arrow ω1 is associated with a control device 10 which comprises (see FIGS. 3, 4, 5, 6, 7):

- a support 11 adapted to be mounted on and fixed to a wall 5*b* of the casing 5 of the wheel 1,
- a shaft 12 mounted to rotate freely on said support 11 and to slide axially (axis Z) relative to said support. 11,
- a swing-arm 13 mounted at one end 12A of the shaft 12,
- a button 14 mounted at the other end 12B of the shaft 12,
- a spring system 15, and
- abutments 20, 21 for limiting the axial displacement Z of the shaft 12 relative to the support 11.

The axial displacement Z of the shaft 12 moves the portion 18 of the swing-arm 13 into a small portion of the shower G of abrasives leaving the wheel 1. This axial displacement of the shaft 12 is effected against the action of the spring 15. Thus in a rest position the spring 15 ensures that the swing-arm 13 is not in the shower G of abrasives leaving the wheel 1. The spring 15 also ensures that, as soon as no pressure is exerted on the button 14, the swing-arm 13 returns to and is retained in its rest position (the position in FIG. 6, the space Y1 being occupied by a wall of the casing 5 and its lining 9). Displacement of the shaft 12 relative to the support 11 is guided by a front bearing 19A and a rear bearing 19B, said bearings 19A, 19B allowing free rotation of the shaft 12.

The button 14 is advantageously outside the casing or the wall of the blasting cabin so that displacement of the shaft 12 is controlled from outside the blasting cabin during and/or after a blasting operation.

The swing-arm 13 comprises:

- a rectilinear member 18 adapted to be placed in a portion of the shower G of abrasives leaving the wheel 1 when pressure is exerted on the button 14 to move the device from its rest position Y1 (FIG. 6) to its working position (FIG. 7, the distance Y2 being greater than Y1) by axial displacement Z of the shaft 12;
- a half-disk 16 placed above the fixing to the shaft 12, said half-disk 16 serving as a counterweight for the strip 18, which is an integral part of the swing-arm 13 and is attached to the shaft 12 by one or more bolts 17.

By appropriately combining the masses of the strip 18 and the counterweight half-disk 16, the centre of mass of the swing-arm 13 is on the axis C. The positions in space of the swing-arm 13 are thus immaterial.

The swing-arm 13 or at least the element 18 is advantageously produced in a manner resistant to abrasion by the abrasives leaving the abrasive blasting wheel 1. The swing-arm 13 is made in one piece, for example, but may equally be produced in a number of parts. For example, the part 18 of the swing-arm 13 subjected to the action of the abrasives during a control or measuring operation may be provided with a protective covering, for example one or more plates with high abrasion resistance, for example plates of tungsten carbide or other ultra-hard alloys offering exceptional resistance to wear (tungsten carbide, nitride, ceramic, etc.).

The part 18 of the swing-arm subjected to the action of the abrasives may be removable and produced in a high-hardness alloy such as tungsten carbide. This strip 18 is then fixed by screws embedded in the support of the swing-arm 13.

Figure 4:
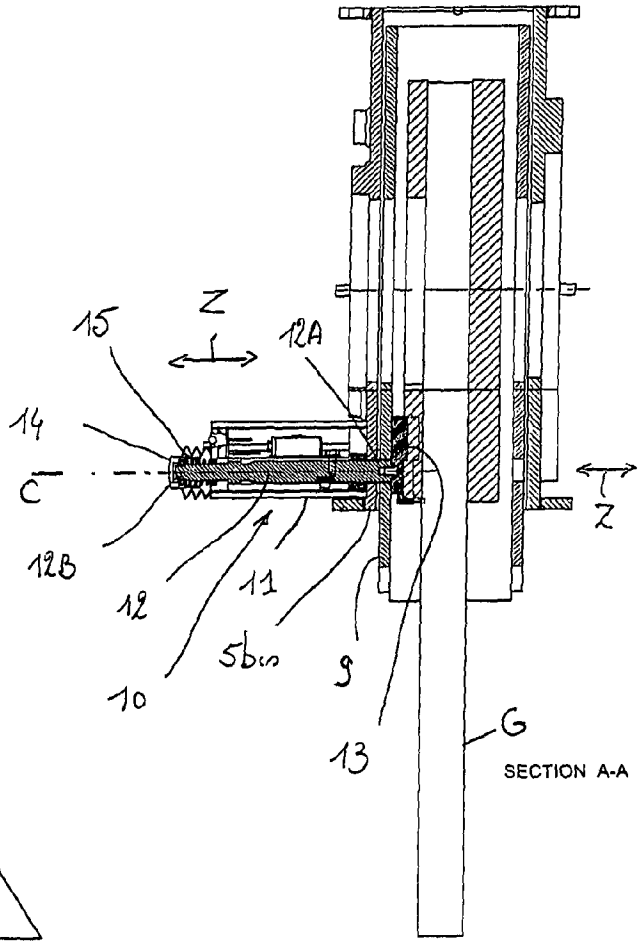
FIG. 4 is a view of the wheel from FIG. 3 partially in section.
Figure 6:
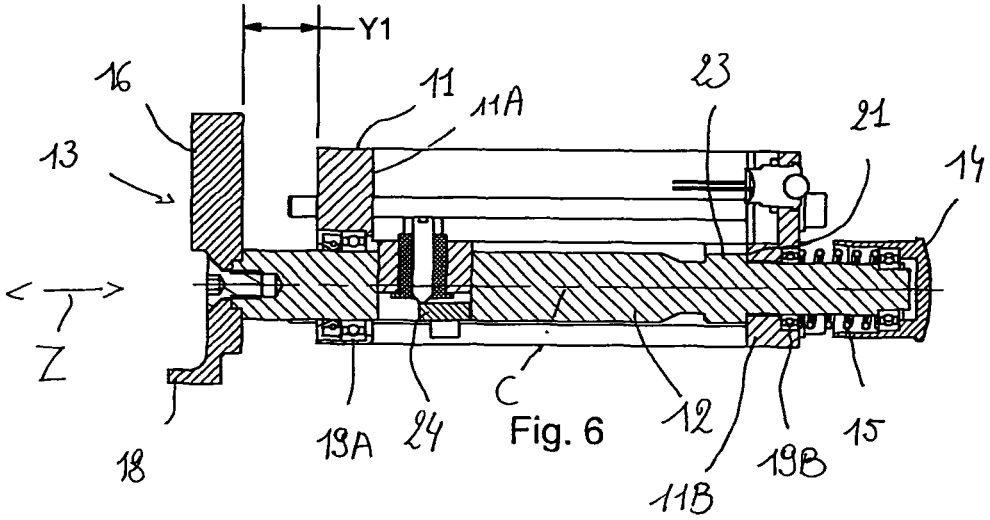
FIGS. 6 and 7 are views in section of the control device from FIG. 5 in its rest position and in its working position.
Figure 7:
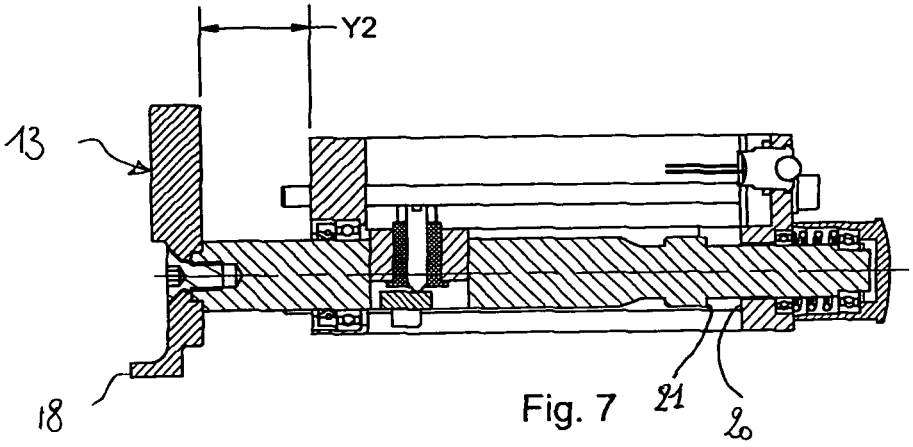

FIGS. 4, 6 and 7 show the measuring system with the manual measuring system in place.

The placement button 14 must be mounted freely on the shaft 12. To this end, the button is mounted on a bearing the interior race of which is fastened to the shaft 12. A return spring 15 bearing on the exterior race of the bearing returns the shaft 12 to the rest position as soon as pressure is no longer applied to the button 14.

This rest position, FIG. 6, is that with the swing-arm 13 pressed against the wall of the lining 9 from FIG. 4. The increased diameter of the shaft 12 defines a wall 21; in the rest position this wall 21 is 1 mm to 2 mm from the wall of the support 11B of the measuring device, with the result that the return force of the spring 15 presses the swing-arm 13 appropriately against the wall of the lining 9 and prevents much of the dust and abrasives reaching the measuring system.

In the embodiment shown, the shaft 12 has in its part situated between the walls 11A and 11B a milled flat 23 which defines a flat-bottom channel intended to receive a bar 24. The bar 24 bears on the bottom of the flat 23 and is fixed to the shaft 12 by two, three or four screws 25.

When the swing-arm 13 is in its control or measuring position (FIG. 7), i.e. when abrasives act on the flat 18 of the swing-arm or a protective covering, the swing-arm is rotated or subjected to a rotation torque that generates rotation of the shaft 12 or a rotation torque if the resultant of the momentum (m·v) forces of the abrasives on the swing-arm is not on the rotation axis thereof.

If the resultant of the momentum (m·v) forces of the abrasives on the swing-arm is a vector passing through the rotation axis of the swing-arm (which is the rotation axis C of the shaft 12), no rotation torque is generated on said shaft. This position is considered the ideal adjustment of the hot spot of the wheel 1 or possibly as a reference point. It is obvious that the measuring device must be placed at the ideal distance "dp" in FIG. 3. Each wheel has its "dp" value defining the plane V1 perpendicular to the target plane PC, FIG. 3, where the impact energy is at a maximum, point H.

If this resultant of the forces is not on the rotation axis of the swing-arm (the axis of the shaft 12), the rotation of the shaft 12 then causes pivoting of the swing-arm 13 and the bar 24 that is fastened to it or a rotation torque on the swing-arm 13 and the bar 24, indicating the value of the displacement and the direction of the hot spot. The bar 24 then has one end bearing on a load cell or sensor, for example a piezo-electric sensor 26A or 26B, according to the direction of rotation of the swing-arm. The value measured by the load cell or sensor 26A or 26B is then a function of the direction and the density of the distribution of the abrasives and makes it possible to determine the position of the hot spot or of an area containing the hot spot.

This makes it possible to determine the adjustment of the control member to obtain the ideal hot spot. This determination of the adjustment parameter will take into consideration the type of abrasives used, the dimensions of the wheel, the rotation speed of the wheel, the friction of the abrasives in the wheel, the distributor and the control member and their degree of wear.

The device of the invention makes it possible to measure the resultant of the forces substantially instantaneously. This further makes it possible to determine any variations in the direction of the jet of abrasives, for example because of a defect in a blade 4, the distributor, etc. Such analysis is not possible with the prior art methods.

The swing-arm 13 is advantageously placed relative to the wheel so that its rotation axis C (the rotation axis of the shaft 12) is parallel to the rotation axis X of the wheel. The rotation axis C of the swing-arm is advantageously in a plane V1 perpendicular to the target plane and passing through the ideal hot spot H of the wheel. The rotation axis C is then in the line of the resultant speed vector of the abrasives perpendicular to the target plane PC. The distance "dp" is a characteristic of the blasting process, to be more precise of the constructional parameters of the wheel and the abrasives thrown off the wheel.

The control device makes it possible to determine if the control member 7 of the wheel 1 placed in its reference position still allows a dense jet of abrasives to be produced in the direction of the ideal hot spot H and/or correction of the angle of the control member 7 to obtain a dense jet of abrasives in the direction of the ideal hot spot H. Once this adjustment has been effected, the adjustment of the control member 7 to obtain for the abrasives a hot spot H' or H" different from the ideal hot spot H may be determined by means of curves, charts or formulas, advantageously by computer. To reach a point H', the vector J must turn through an angle 'alpha', for example; the control member 7 must therefore be turned through the same angle 'alpha' for the required hot spot different from the ideal hot spot to be at H'. These curves, charts or formulas make it possible to determine the rotation in degrees of the control member to obtain a hot spot offset relative to the ideal hot spot.

For example, if for the requirements of abrasive blasting the desired hot spot is H', to arrive at H' the speed vector J must turn 8° to the right, for example. When the control member is adjusted to reach the ideal hot spot H, it will suffice to turn the control member 8° relative to the preceding position in the direction of rotation of the wheel 1 to reach the hot spot H', the required but not ideal hot spot. The measuring device thus makes it possible to determine the original angle of the control member 7 ensuring the ideal adjustment of the hot spot, giving a zero torque on the swing-arm, and also to determine the adjustment of a required but not necessarily ideal hot spot. This desired new hot spot H' does not cancel the torque exerted by the jet of abrasives on the measuring swing-arm.

Once this angular position of the control member has been determined, the options are:

- to adopt this ideal or reference position, or
- to adopt another, required position of the hot spot to meet the requirements of abrasive blasting.

This is because the adjustment of the hot spot to be used depends on detecting the correct positioning of the control member 7 ensuring the ideal hot spot at the distance "dp" relative to the orthogonal projection of the rotation axis X of the wheel 1.

In various embodiments it is possible to replace the load cells or sensors 26A and 26B from FIG. 11 with isolated mechanical abutments provided with electrical contacts or on/off switches 27A and 27B (see FIG. 12).

During the measurement phase, if the hot spot is adjusted to the ideal position, no tilting torque is exerted on the bar 24, no switch is actuated and no current flows in any of the switches. In this case, the hot spot controller will indicate, via a signalling device such as an indicator lamp, for example a green indicator lamp (green lamp 100), that the adjustment of the ideal hot spot has been done. As soon as the hot spot is not ideal, a tilting torque appears immediately and one of the switches is actuated. A red indicator (red lamp 101 or 102) is then lit and the position of this red indicator indicates to which side the hot spot has moved, to the left or right of the ideal (FIG. 12).

In the measuring position of the swing-arm 13, a portion of it is in the jet of abrasives leaving the wheel 1. If the bar 24 does not come into contact with the abutments/switches, no red lamp is lit and/or one or more green indicator lamps is/are lit (in FIG. 12, the middle green lamp 100 is lit when none of the contacts is actuated and the ideal adjustment is reached). The control member 7 is then in a position corresponding to the ideal hot spot H. If the bar 24 acts on an abutment or a contact, one or more indicator lamps (101), for example red indicator lamps, is lit, the bar 24 or the contact closing an electric circuit. One or more lamps is/are advantageously lit to signal that it is necessary to turn the control member 7 in one direction to move the real hot spot closer to the ideal hot spot H, while other lamps are lit to signal that it is necessary to turn the control member 7 in an opposite direction to move the real hot spot closer to the ideal hot spot. Advantageously, if the red lamp 101 to the right of the central green lamp is lit it is necessary to turn the control member 7 to the right and, vice-versa, if the left-hand red lamp 102 is lit it is necessary to turn the control member to the left.

This simplified device therefore facilitates finding the ideal or reference hot spot H and, using charts, curves or formulas, determining the rotation of the control member 7 required to obtain a desired hot spot H' for abrasive blasting of the part to be abrasive blasted that is different from the ideal hot spot.

With such a device it is possible during abrasive blasting to control the appropriate positioning of the jet of abrasives toward the part to be abrasive blasted.

If the control member can be adjusted during abrasive blasting by a system of gears or more generally by an electric actuator it is possible, at least in a discontinuous manner, to control the actual principal direction of the jet of abrasives relative to the required principal direction of the jet of abrasives, and to determine, for example automatically by means of a computer or processor, the corrective rotation angle to be applied to the control member to move the actual principal abrasive blasting direction toward the required abrasive blasting principal direction, ideal or otherwise, to ensure a consistent quality of abrasive blasting over time, which enables reduction of the risk of over-blasting of parts and/or an improved yield in terms of abrasive blasted parts and/or a more consistent quality of abrasive blasted parts.

FIGS. 8, 8*bis*, 9, 10 show the four control devices with different means for moving the swing-arm 13 between its rest position and its working position. FIG. 8 represents a system similar to that from FIG. 4 except that the device comprises a first part 200 and a second part 300 that are attached (for example screwed or clipped) to each other. The first part includes part of the shaft 12 carrying at its free end the swing-arm 13, this part of the shaft 12 being mounted to move axially relative to the first part 200. The end of the shaft 12 opposite that carrying the swing-arm 13 features or includes means 201 that cooperate with a control member 301. The control member 301 is mounted to rotate relative to the second part.

In the FIG. 8 embodiment, the control member is a pushbutton with (spring) return means, said pushbutton being attached to a rod (302) the free end of which features or includes means 303 for connecting it to the shaft 12. In FIG. 8, the pushbutton is a manual control member.

FIG. 8*bis* shows another manually controlled embodiment in which the shaft 302 is replaced by a screw 321 mounted on two bearings 323. On turning the thumbwheel 322 fastened to the screw 321 the shaft 12 carrying the swing-arm 13 is moved toward its measuring position; it is withdrawn from that measuring position to its rest position upon reverse rotation of the screw 321. The threaded shank of the screw 321 cooperates with a threaded hollow at one end of the rod 12 or a part 324 rotationally attached to the end of the rod 12, said part 324 being guided by one or more guides so that the rotation movement of the thumbwheel 322 drives translation movement of the part 324 and thus translation movement of the rod 12.

In the FIG. 9 embodiment, the control device includes a first part similar to that from FIG. 8. The second part 300 of the FIG. 9 device includes a pneumatic control member 305. The member 305 is housed in a chamber 306 and a spring 307 acts on said member to return it to its rest position (the position in which the swing-arm is not operated). The body 300 has a connection or passage 308 for a supply of fluid (gas or liquid) under pressure. The control member 305 has at its free end the means 303 for connecting it to the shaft 12.

The FIG. 10 control device includes a first part similar to that from FIG. 8. The second part includes a body 300 defining a chamber 306 in which a solenoid control member 311 is placed. On activation of the solenoid by an electric signal, the control member is moved against the spring 307 to act on the shaft 12 and move the swing-arm 13 into its working position. As soon as the signal is interrupted or insufficient, the spring 307 returns the member 311 to its rest position. The solenoid system is particularly suitable for short fast strokes.

As in the manual system shown in FIG. 4, all the controls in FIGS. 8 to 10 are operated from outside the abrasive blasting cabin.

The device 10 for controlling correct operation of the wheel 1 or correct adjustment of the position of the control member 7 of the abrasive blasting wheel 1 is controlled from outside the abrasive blasting cabin. The position of the swing-arm 13 is predefined so that the operator, whilst remaining outside the hot atmosphere inside the abrasive blasting cabin, can easily control the movement of the swing-arm 13 to control the principal direction of the jet of abrasives and/or to adjust the control member toward its position corresponding to the ideal or required hot spot of the wheel. Based on this control or correct positioning of the control member of the wheel, the operator can determine from curves or formulas the necessary angular rotation of the control member 7 to obtain the required hot spot for the abrasives leaving the wheel 1. This determination and correction of the position of the control member 7 may where appropriate be automatic or semi-automatic, for example controlled by a computer.

The position of the control member may be adjusted automatically, continuously, plateau by plateau or step by step, and may be controlled by an automaton programmable with pre-programmed control and/or correction parameters. The control device may also be remote-controlled.

The control device makes it possible during abrasive blasting of a part or between abrasive blasting of two successive parts to determine a parameter as a function of the torque generated or the rotation of the swing-arm (13). The control device is then advantageously associated with means for sending a signal as a function of this parameter to a device for comparing this signal to a permissible range or to non-permissible ranges, this comparator device then sending a signal warning of incorrect adjustment of the wheel and/or a signal for stopping operation of the wheel and/or a signal for correcting the position of the control member 7.

The control member 7 of the wheel is advantageously adjusted by means of a system (for example an actuator or gears) providing stepwise rotation of the control member 7 relative to the support or casing 5, especially during abrasive blasting. The system for rotating the control member may be motorised, for example by an electric actuator, enabling remote adjustment or determination of the hot spot.

Using a motorised system for adjusting the position of the control member during abrasive blasting enables variation of the principal direction of the jet, continuously, substantially continuously or stepwise, for example as a function of a target to be reached, for example as a function of the movement of a target to be reached.

The control device of the invention for correctly adjusting the position of the control member 7 of the wheel also enables controlling of the appropriate distribution of a manifold of abrasive blasting nozzles or any other device requiring controlling of parts of flows on either side of the axis C of the part or balance arm 13.

The invention claimed is:

1. A method of controlling or adjusting a surface treatment effected by abrasive blasting by means of abrasion agents or abrasives from a surface treatment device including an abrasive blasting wheel driven in rotation about an axis and emitting a jet of abrasion agents or abrasives, said abrasion blasting wheel including straight or curved blades, a support or casing on which the wheel is rotatably mounted, an abrasives distributor placed at the centre of the wheel and fastened to the wheel, and a control member that is not driven in rotation during rotation of the wheel, placed around the distributor, said control member having a slot or opening controlling the feeding of abrasives to the blades and controlling the exit of the jet of abrasives from the wheel after said abrasives have been moved along the blades by centrifugal force, said control member being mounted movably with respect to the support to allow adjustment of the position of the slot or opening of the control member relative to the support, to control the exit of the jet of abrasives, wherein a control device is used including at least one swing-arm mounted movably relative to a wall protected by a lining of a wheel casing or an abrasive blasting chamber, said wall and lining having a first face facing toward the jet of abrasives leaving the wheel and a second face opposite said first face, said second face facing toward an area protected from the abrasive blasting, said swing-arm being mounted movably relative to said first face between a first position for which the swing-arm is not situated in the jet of abrasives leaving the wheel and a second position in which the swing-arm or an element thereof is situated in part of the jet of abrasives leaving the wheel, said swing-arm being mounted rotatably relative to an axis substantially parallel to the rotation axis of the abrasive blasting wheel so that in the second position of the swing-arm the jet of abrasion agents or abrasives acting on the swing-arm or the element is able to generate a rotation torque;

said method comprising at least the following steps:

controlling the movement of the swing-arm from outside the casing of the wheel or from outside the abrasive blasting cabin via a placement device, from its first position toward its second position from an area protected from the abrasive blasting, to move said swing-arm or an element thereof into a portion of the jet of abrasives leaving the wheel;

determining at least one parameter as a function of any rotation torque generated and/or as a function of any rotation of the swing-arm;

determining as a function of said parameter or the measurement a parameter as a function of a hot spot and/or a parameter for adjusting the position of the control member of the wheel in order to obtain a required hot spot;

optionally correcting the position of the control member of the wheel; and moving the swing-arm of the control device from its second position toward its first position to move said swing-arm out of the jet of abrasives leaving the wheel.

2. A method according to claim 1, wherein said blades extend between two flanges or disks.

3. A method according to claim 1, wherein a control parameter and/or a correction parameter is/are determined for the control member of the wheel as a function of one or more parameters as a function of any rotation torque and/or any rotation of the swing-arm of the control device, at least before and/or during an abrasive blasting operation, and as a function of the required hot spot, and wherein the position of the control member of the wheel is adjusted by rotation as a function of said control parameter and/or said correction parameter of the control member of the wheel.

4. A method according to claim 1, for an abrasive blasting wheel having a given ideal hot spot, wherein said swing-arm and/or said member is/are moved between the first position and the second position before and/or during abrasive blasting, wherein the position of the control member of the wheel is adjusted so that the jet of abrasives leaving the wheel is directed to produce the ideal hot spot of the wheel, wherein a necessary rotation of the control member of the wheel relative to the position of the control member producing the ideal hot spot is determined as a function of at least one predefined curve or formula and as a function of the required hot spot in order to direct the jet of abrasives leaving the wheel to produce the required hot spot.

5. A method according to claim 1, wherein, if the parameter as a function of any rotation torque generated and/or any rotation of the swing-arm is no longer included in a range of permissible values, at least one signal is sent and/or abrasive blasting is stopped and/or the position of the control member of the wheel is adjusted so that said parameter as a function of any rotation torque generated and/or any rotation of the swing-arm is included in a range of permissible values, said range of permissible values advantageously being a range of values determined relative to the required or ideal hot spot of the wheel.

6. A method according to claim 5, wherein a range of values offset relative to the range of values is determined relative to the ideal hot spot.

7. A method according to claim 1, wherein the control member of the wheel is associated with means for adjusting the position of the control member a relative to the support, said means including at least one electric actuator or gears for stepwise rotation of the control member of the wheel relative to the support.

8. A method according to claim 7, wherein the control member of the wheel is associated with means for adjusting the position of the control member relative to the support during abrasive blasting.

9. A method according to claim 1, wherein said swing-arm is moved against the action of return means between its first position and its second position so that said return means at least return said swing-arm to its first position.

10. A method according to claim 1, for a wheel having an ideal plane in which abrasives or abrasion agents are moved toward a target plane perpendicular to said ideal plane with maximum impact energy, wherein said swing-arm is placed so that its rotation axis is situated in or substantially in said ideal plane.

11. A method of surface treatment of an object by abrasive blasting by means of abrasion agents or abrasives from a surface treatment device including an abrasive blasting wheel, said abrasive blasting wheel including (a) blades, (b) a support on which the wheel is rotatably mounted, (c) an abrasives distributor placed at the centre of the wheel and fastened to the wheel, and (d) a control member not driven in rotation during rotation of the wheel, placed around the distributor, said control member having a slot or opening controlling the feeding of abrasives toward the blades and the exit of the jet of abrasives from the wheel after said abrasives have been moved along the blades by centrifugal force, said control member being mounted movably relative to the support to allow adjustment of the position of the slot or opening of the control member relative to the support to control the exit of the jet of abrasives, said method including, at one or more predetermined times in the surface treatment of the object by abrasive blasting or at one or more times between the abrasive blasting of two successive objects, at least one step of controlling the exit of the jet of abrasives by a method of controlling or adjusting a surface treatment effected by abrasive blasting by means of abrasion agents or abrasives from a surface treatment device including the abrasive blasting wheel driven in rotation about an axis and emitting a jet of abrasion agents or abrasives, wherein a control device is used including at least one swing-arm mounted movably relative to a wall protected by a lining of a wheel casing or an abrasive blasting chamber, said wall and lining having a first face facing toward the jet of abrasives leaving the wheel and a second face opposite said first face, said second face facing toward an area protected from the abrasive blasting, said swing-arm being mounted movably relative to said first face between a first position for which the swing-arm is not situated in the jet of abrasives leaving the wheel and a second position in which the swing-arm or an element thereof is situated in part of the jet of abrasives leaving the wheel, said swing-arm being mounted rotatably relative to an axis substantially parallel to the rotation axis of the abrasive blasting wheel so that in the second position of the swing-arm the jet of abrasion agents or abrasives acting on the swing-arm or the element is able to generate a rotation torque;

said method of controlling or adjusting a surface treatment comprising at least the following steps:

controlling the movement of the swing-arm from outside the casing of the wheel or from outside the abrasive blasting cabin via a placement device, from its first position toward its second position from an area protected from the abrasive blasting, to move said swing-arm or an element thereof into a portion of the jet of abrasives leaving the wheel;

determining at least one parameter as a function of any rotation torque generated and/or as a function of any rotation of the swing-arm;

determining as a function of said parameter or the measurement a parameter as a function of a hot spot and/or a parameter for adjusting the position of the control member of the wheel in order to obtain a required hot spot;

optionally correcting the position of the control member of the wheel; and moving the swing-arm of the control device from its second position toward its first position to move said swing-arm out of the jet of abrasives leaving the wheel.

12. A method according to claim 11, wherein said blades extend between two flanges or disks.

13. A method according to claim 11, wherein at least one step of controlling the exit of the jet of abrasives is carried out at least at the beginning of abrasive blasting of an object.

14. A method according to claim 11, wherein a series of objects is treated successively, continuously or semi-continuously by abrasive blasting, wherein at least one step of controlling the jet of abrasives is carried out at least once per abrasive blasting period of 24 hours or less.

15. A method according to claim 14, wherein at least one step of controlling the jet of abrasives is carried out at least once per abrasion blasting period of 8 hours or less.

16. A method according to claim 11, wherein the parts are abrasive blasted in substantially optimum manner with a jet of abrasion agents or abrasives leaving at a predetermined angle relative a straight line substantially perpendicular to the target plane and passing through the rotation axis of the wheel, wherein, after an operation of controlling the exit of the jet of abrasives from the wheel, a corrective parameter of the position of the slot or opening of the control member is determined and wherein the position of the slot or opening is modified during abrasive blasting or between the abrasive blasting of two successive parts.

17. A device adapted to control or adjust exit of a jet of abrasion agents or abrasives from a surface treatment device including an abrasive blasting wheel driven in rotation about an axis and emitting the jet of abrasion agents or abrasives, said device comprising:

(a) a support adapted to be mounted on a wall protecting against the jet of abrasion agents or abrasives leaving the abrasive blasting wheel;

(b) a swing-arm mounted movably relative to the support between a first position in which the swing-arm is close to said support so that when said support is mounted on the protective wall the swing-arm is not situated in the jet of abrasives leaving the wheel and a second position in which the swing-arm or an element thereof is away from the support so that when said support is mounted on the protecting wall the swing-arm thereof is situated in a portion of the jet of abrasives leaving the wheel; and (c) at least one system that determines at least one of a parameter as a function of a hot spot or a parameter for adjusting the position of a control member of the wheel in order to obtain a required hot spot based on at least one parameter as a function of at least one of any rotation torque generated or any rotation of the swing-arm resulting from the swing arm or an element thereof being situated in a portion of the jet of abrasives; and (d) a placement device that controls the movement of the swing-arm from outside the casing of the wheel or from outside the abrasive blasting cabin, from its first position toward its second position from an area protected from the abrasive blasting, to move said swing-arm or an element thereof into a portion of the jet of abrasives leaving the wheel.

18. A device according to claim 17, wherein the swing-arm is mounted to rotate freely relative to the support and wherein the system is adapted to measure or estimate a parameter as at least one of a function of the rotation torque generated by the abrasives on the swing-arm or as a function of the rotation of the swing-arm generated by the jet of abrasives.

19. A device according to claim 17, wherein the swing-arm at least a rod or a shaft sliding in a guide system fastened to the support to guide the movement of the part between its first position and its second position.

20. A device according to claim 17, further comprising return means acting on the swing-arm or a part fastened thereto to return the swing-arm from its second position, the movement of the swing-arm from its second position to its first position being effected against the action of said return means.

21. A device according to claim 17, further comprising one or more connections for sending one or more signals to at least one of an alarm or indicator system or to a system for determining a correction parameter for the position of the control member of the wheel or to a system for correcting the position of the control member of the abrasive blasting wheel or to a system for indicating or storing one or more parameters of an abrasive blasting operation.

22. An assembly selected from the group consisting of abrasive blasting wheel casing, abrasive blasting wheel and abrasive blasting cabin, said assembly being associated with at least one control device adapted to control or adjust exit of a jet of abrasion agents or abrasives from a surface treatment device including an abrasive blasting wheel driven in rotation about an axis and emitting the jet of abrasion agents or abrasives, said device including:

(a) a support adapted to be mounted on a wall protecting against the jet of abrasion agents or abrasives leaving the abrasive blasting wheel;

(b) a swing-arm mounted movably relative to the support between a first position in which the swing-arm close to said support so that when said support is mounted on the protective wall the swing-arm is not situated in the jet of abrasives leaving the wheel and a second position in which the swing-arm or an element thereof is away from the support so that when said support is mounted on the protecting wall the swing-arm or the element thereof is situated in a portion of the jet of abrasives leaving the wheel; and (c) at least one system that determines at least one of a parameter as a function of a hot spot or a parameter for adjusting the position of a control member of the wheel in order to obtain a required hot spot based on at least one parameter as a function of at least one of any rotation torque generated or any rotation of the swing-arm resulting from the swing arm or an element thereof being situated in a portion of the jet of abrasives; and (d) a placement device that controls the movement of the swing-arm from outside the casing of the wheel or from outside the abrasive blasting cabin, from its first position toward its second position from an area protected from the abrasive blasting, to move said swing-arm or an element thereof into a portion of the jet of abrasives leaving the wheel.

* * * * *